US009326553B1

(12) United States Patent
Ross et al.

(10) Patent No.: US 9,326,553 B1
(45) Date of Patent: May 3, 2016

(54) STRESS TEST BRA

(71) Applicants: Sheryl Ross, Santa Monica, CA (US); Jennifer Dixon, Sherman Oaks, CA (US); Jeanne Cohen, Chicago, IL (US)

(72) Inventors: Sheryl Ross, Santa Monica, CA (US); Jennifer Dixon, Sherman Oaks, CA (US); Jeanne Cohen, Chicago, IL (US)

( * ) Notice: Subject to any disclaimer, the term of this patent is extended or adjusted under 35 U.S.C. 154(b) by 0 days.

(21) Appl. No.: 14/695,643

(22) Filed: Apr. 24, 2015

(51) Int. Cl.
*A41C 3/00* (2006.01)
*A41C 3/02* (2006.01)

(52) U.S. Cl.
CPC ..... *A41C 3/0064* (2013.01); *A41C 3/02* (2013.01)

(58) Field of Classification Search
CPC ..... A41C 3/00; A41C 3/0014; A41C 3/0028; A41C 3/005; A41C 3/0057; A41C 3/0064; A41C 3/0071; A41C 3/0078; A41C 3/02; A41C 3/04; A41C 3/06; A41C 3/10; A41C 3/142; A41C 3/144; A41C 3/148
USPC ..... 450/14–17, 23, 25, 30, 31, 27, 28, 58, 450/54–57, 79, 85, 64, 91, 86, 88, 89
See application file for complete search history.

(56) References Cited

U.S. PATENT DOCUMENTS 1,417,930 A * 5/1922 Mailleue ..... A41C 3/10 450/57
3,040,750 A * 6/1962 Hurwitz ..... A41C 3/02 450/58
3,094,125 A * 6/1963 Lewis ..... A41C 3/148 450/59
3,826,266 A * 7/1974 Alpert ..... A41C 3/0071 2/73
4,185,332 A * 1/1980 Jahnig ..... A61F 2/52 450/54
6,220,924 B1 * 4/2001 Kobayashi ..... A41C 3/0092 450/1
6,402,586 B1 * 6/2002 Winik ..... A41C 3/0064 450/1
6,604,983 B1 * 8/2003 Denn ..... A41C 3/148 450/1
2002/0022434 A1 * 2/2002 Plourde ..... A41F 1/006 450/86
2010/0297913 A1 * 11/2010 Liegey ..... A41C 3/0071 450/39
2012/0135667 A1 * 5/2012 Chan ..... A41C 3/0092 450/58
2012/0220193 A1 * 8/2012 Thompson ..... A41C 3/0064 450/93
2013/0017760 A1 * 1/2013 Kadium ..... A41C 3/148 450/30
2013/0303050 A1 * 11/2013 Jackson ..... A41C 3/00 450/38
2013/0316616 A1 * 11/2013 Thompson ..... A41F 15/002 450/66
2014/0162531 A1 * 6/2014 Mazourik ..... A41C 3/0071 450/86

* cited by examiner

*Primary Examiner* — Gloria Hale
(74) *Attorney, Agent, or Firm* — Duane Morris LLP

(57) ABSTRACT

A bra particularly suited for use during stress echocardiogram tests. The bra includes two cups for breasts, with at least one of the cups being removably securable. The bra also includes at least one retaining and/or supportive band that keeps one of the cups completely or at least partially in its normal position on a person while the other cup is not secured. In some aspects, the retaining and/or supportive band also is removably securable and/or forms at least part of one of the cups. The bra may further include at least one window in at least one of the cups for electrocardiogram leads. The bra may also include one or more strap adjusters, at least one window in at least one of the cups on the heart side for access of a sonogram or other sensor or imaging device, and one or more clasps for test leads.

9 Claims, 4 Drawing Sheets

STRESS TEST BRA

CROSS-REFERENCE TO RELATED APPLICATION

Not applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND

The present disclosure generally relates to a bra particularly suited for use by women during stress tests, for example stress echocardiogram tests.

SUMMARY

Aspects of the subject technology include a bra particularly suited for use during stress echocardiogram tests. The bra includes two cups for breasts, with at least one of the cups being removably securable. The bra also includes at least one retaining and/or supportive band that keeps one of the cups completely or at least partially in its normal position on a person while the other cup is not secured. In some aspects, the retaining and/or supportive band also is removably securable and/or forms at least part of one of the cups. The bra may further include at least one window in at least one of the cups for electrocardiogram leads. The bra may also include one or more strap adjusters and at least one window in at least one of the cups on the heart side for access of a sonogram or other sensor or imaging device. In addition, one or more clasps for test leads may be included. At least one of the cups and/or the retaining and/or supportive band preferably is made of a flexible supportive material such as Spandex.

This brief summary has been provided so that the nature of the invention may be understood quickly. Additional and/or different features from those set forth in this summary may be included. A more complete understanding of the invention may be obtained by reference to the following description in connection with the attached drawings.

DETAILED DESCRIPTION

Figure 1:
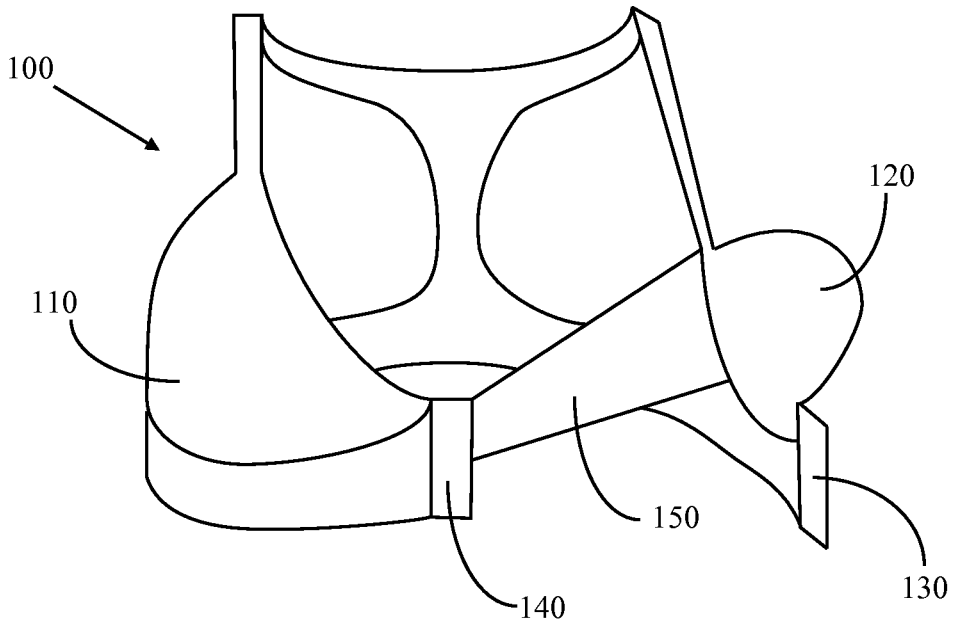
FIG. 1 illustrates an example of a bra according to aspects of the subject technology.

Briefly, techniques according to aspects of the subject technology include a bra particularly suited for use during stress echocardiogram tests. These kind of tests, as well as other stress tests, are essential tools for diagnosing heart disease (i.e., cardiovascular disease).

Heart disease is one of the most prevalent causes of death among women in the world and especially in the United States of America, where the disease afflict approximately 1 in 4 women. While heart disease death rates among men have declined steadily over the last 25 years, rates among women have fallen at a far slower rate The myth that heart disease is a "man's disease" has been debunked; the rate of public awareness of cardiovascular disease ("CVD") as the leading cause of death among US women has increased from 30% in 1997 to 54% in 2009. Despite gains in diagnosis and treatment, considerable challenges remain.

In 2007, CVD still caused 1 death per minute among women in the United States, or over 400,000 deaths that year. More women were killed by CVD than cancer, chronic lower respiratory disease, Alzheimer disease, and accidents combined. Reversing a trend of the past decades, CVD death rates in US women 35 to 54 years of age now actually appear to be increasing, likely because of the effects of the obesity epidemic.

The situation is worse for black and Hispanics females compared to their Caucasian counterparts. A very ominous trend is the ongoing increase in average body weight in the former populations, with nearly 2 of every 3 of those women over 20 years of age now being overweight or obese.

The rise in obesity is a key contributor to the burgeoning epidemic of type 2 diabetes mellitus now seen in 12 million US women. The increasing prevalence of diabetes mellitus is concerning for many reasons, especially for its association with a greatly increased overall risk of myocardial infarction (MI), CVD, and stroke.

The challenge of these diseases in women is not limited to the United States. Recent data document the global scope of the problem: Heart disease (CVD) is the leading cause of death in women in every major developed country and most emerging economies.

One of the most effective tools to diagnose and therefore lead to treatment of these ailments is the stress echocardiogram test. A typical stress test involves having a person run on a treadmill for a period of time in order to increase their heart rate to 85% maximum beats. Measurements are taken before the person runs, for example via EKG (electrocardiogram) leads. After the person has reached their 85% maximum heart rate, further tests typically are performed. These testes preferably are performed within seconds for accurate assessment, for example by moving the person onto an examination table where a technician is able to access the person's beating heart with a heart ultrasound transducer in specific places. Access to the person's left breast is preferable for accurate results.

Some rare individuals exhibit a mirror-image physical structure. The subject technology may be reversed for use with providing stress echocardiogram tests to such individuals.

One problem with stress echocardiogram tests is that people are usually requested to run on the treadmill at steep inclines without any supportive and/or protective clothing on their upper torso. The primary reason for this request is that such conventional clothing may interfere with application of diagnostic instruments such as EKG sensors and leads and/or sonogram sensors. This requirement may be both physically and emotionally uncomfortable for women, resulting in hesitancy to undergo a stress test. In addition, a woman may not exert maximum effort during the test due to the lack of supportive and/or protective clothing for her breasts.

Physically, when a woman runs on a treadmill without any garment (e.g., a bra) on her upper torso, her breasts may move in an uncomfortable manner. This may create physical duress (i.e., pain). Emotionally, women may be uncomfortable running on a treadmill without clothing on their upper torsos while others are present, let alone running with maximal effort. These physical and emotional considerations may discourage women from undergoing a stress test. Furthermore, even if a woman chooses to undergo a stress test, her physical and emotional discomfort may actually influence the stress test results and decrease the test's diagnostic efficacy. Men, particularly overweight men, may also be subject to these concerns.

Aspects of the subject technology address the foregoing issues via a bra that includes two cups for breasts, with at least one of the cups being removably securable. The bra also includes at least one supportive and/or protective retaining band that keeps one of the cups (e.g., the right cup) at least partially in proper anatomical position on a person while the other cup is not secured. In some aspects, the retaining band also is removably securable and/or forms at least part of one of the cups. The bra may further include at least one window in at least one of the cups for electrocardiogram test leads and/or access by other diagnostic instruments. At least the retaining band preferably is made of a flexible supportive material such as Spandex. The preferably supportive and/or protective retaining band also should be constructed such that the band does not interfere with electrocardiogram electrodes and/or heart ultrasound placement before, during, or after a stress test.

In more detail, FIG. 1 illustrates an example of a bra according to aspects of the subject technology. Bra 100 includes cups 110 and 120. At least one of the cups, here left cup 120, is removably securable for example via hook-and-loop fasteners 130 and 140. Other types of fasteners such as buttons, laces, and the like may also be used. Retaining band 150 keeps the other cup at least partially in position when the removably securable cup is not secured. In preferred aspects, the band also provides at least some coverage of a woman's breast, hopefully decreasing potential emotional discomfort.

In use, the bra may be worn with one of the cups not secured. EKG leads may be applied, and then the cup may be secured. The bra therefore may provide a mechanism for properly securing EKG leads while still providing support and a modicum of clothing for a woman undergoing a stress test. In contrast, a standard bra may interfere with placement of electrodes, heart ultrasound instruments, and the like.

Figure 2:
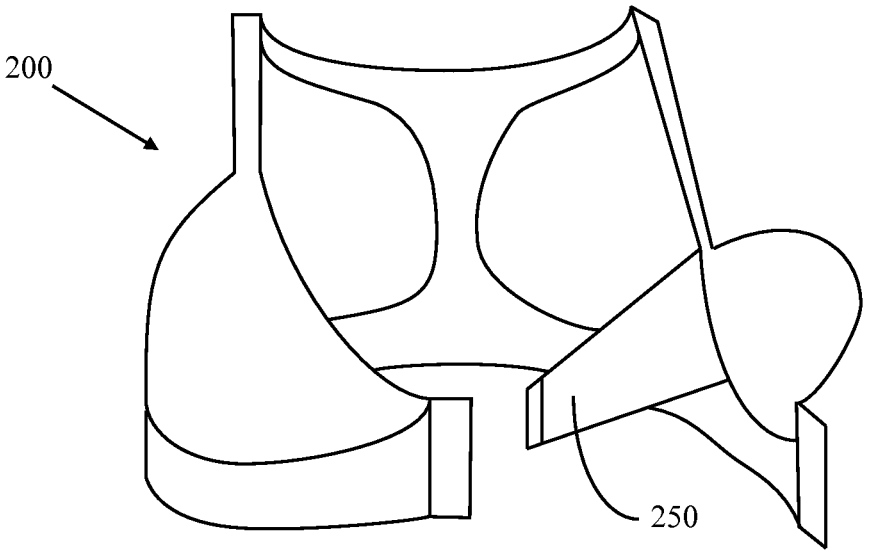
FIG. 2 illustrates an example of a variation of the bra shown in FIG. 1.

FIG. 2 illustrates an example of a variation of the bra shown in FIG. 1. Bra 200 in FIG. 2 includes the feature that retaining band 250 also is removably securable, for example also via a hook-and-loop or other type of fastener. This variation may also facilitate deployment of EKG leads and/or a sonography device or other instrument during a stress test, preferably without any or at least minimal disruption or interference.

Figure 3:
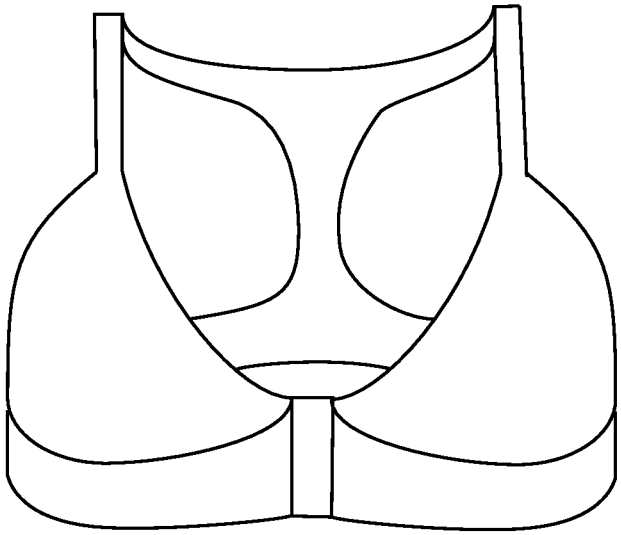
FIG. 3 illustrates an example of the bras shown in FIGS. 1 and 2 in a closed configuration.

FIG. 3 illustrates an example of the bras shown in FIGS. 1 and 2 in a closed configuration.

Figure 4:
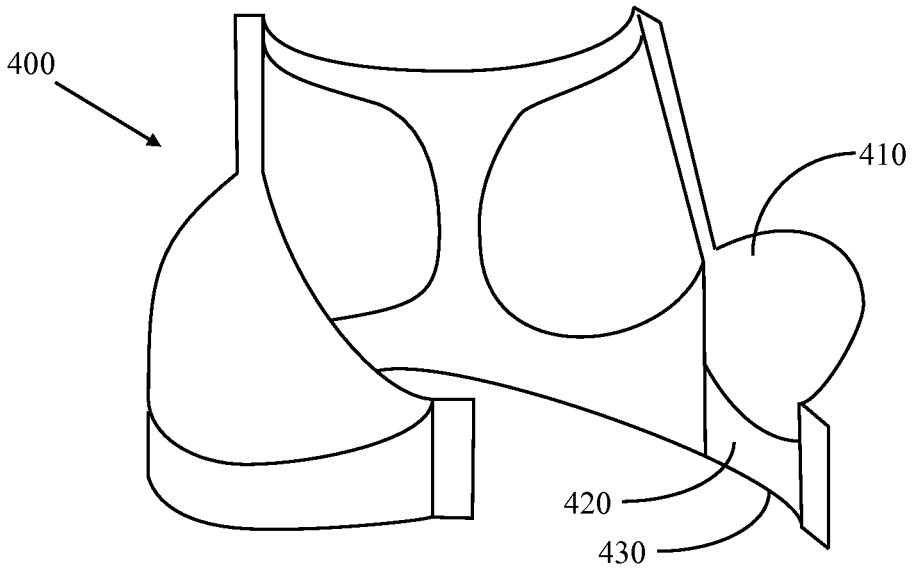
FIG. 4 illustrates another example of a variation of the bra shown in FIG. 1.

FIG. 4 illustrates another example of a variation of the bra shown in FIG. 1. Example bra 400 in FIG. 4 is identical to bra 100 in FIG. 1 except that the retaining band is at least partly formed by cup 410. That cup includes window 420 with bottom edge 430. This window may facilitate deployment of EKG electrodes, leads, and wires, ultrasound instruments, sonography devices, and/or other diagnostic instruments without any disruption the might affect efficacy and accuracy of testing. The window also preferably is higher on an outside edge to provide better access for such diagnostic instruments and/or devices.

Figure 5:
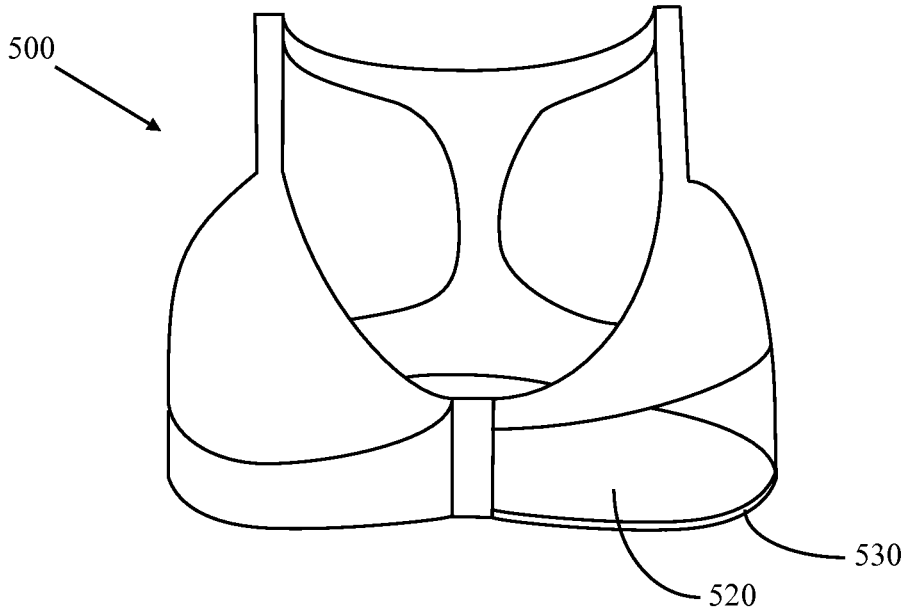
FIG. 5 illustrates an example of the bra shown in FIG. 4 in a closed configuration.

FIG. 5 illustrates an example of the bra shown in FIG. 4 in a closed configuration. Bra 500 in FIG. 5 illustrates window 520 that corresponds to window 420 in FIG. 4 with bottom edge 530 that corresponds to bottom edge 430 in FIG. 4.

In FIGS. 4 and 5, windows 420 and/or 520 preferably curve upward on the outer side to facilitate deployment of EKG leads and/or a sonography device or other instrument during a stress test. In some aspects, the window provides a passages for the leads and associated wires as well as for ultrasound examination once the target heart rate has been achieved.

Figure 6:
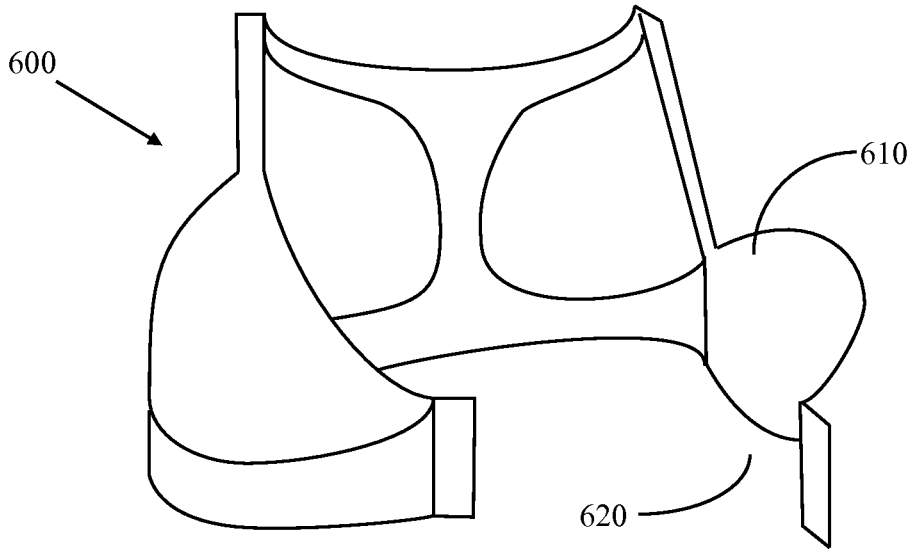
FIG. 6 illustrates an example of a variation of the bra shown in FIG. 4.
Figure 7:
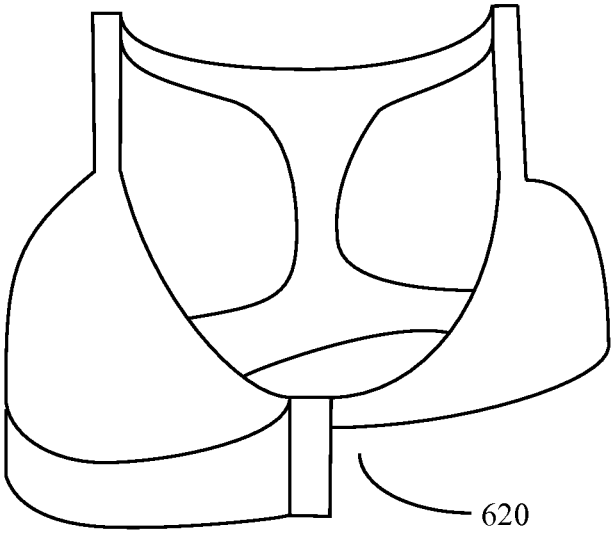
FIG. 7 illustrates an example of the bra shown in FIG. 6 in a closed configuration.

FIG. 6 illustrates an example of a variation of the bra shown in FIG. 4. In example 600 shown in FIG. 6, notch or partial window 620 is open on a bottom edge (e.g., does not include a bottom edge such as edges 430 and 530 shown in FIGS. 4 and 5, respectively). The bottom edge is omitted in this example to help avoid rubbing of the bra on EKG sensors and/or leads, which could cause artifacts such as false positive results. The back side of notch 620 may also be aligned with the rest of the bra so that no part of the bra is unsecured. FIG. 7 illustrates an example of the bra shown in FIG. 6 in a closed configuration.

Figure 8:
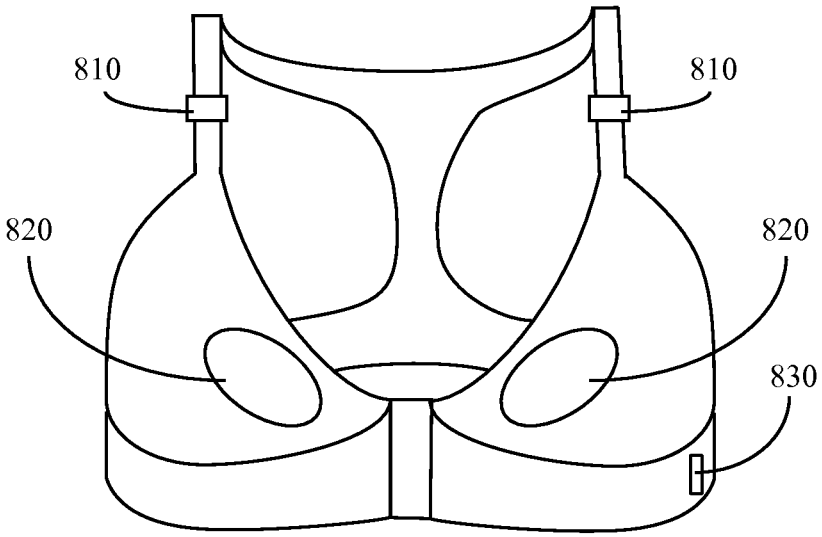
FIG. 8 illustrates possible additional features according to aspects of the subject technology.

FIG. 8 illustrates possible additional features according to aspects of the subject technology. One or more strap adjusters 810 may be included to help with proper fitting of the bra. One or more windows 820 in a "heart side" of one or more of the cups (i.e., near the center of the bra when in a closed position) may also be included to facilitate access of a sonogram or other sensor or imaging device. In addition, one or more clasps 830 to hold test (e.g., EKG electrode) leads may be included. The clasp(s) may be hook-and-loop fastener loops or any other type of clasp(s) that preferably secure the leads in place without undue wear or interference.

As shown in all of these figures, versions of the bra may include a back structure including two shoulder straps, for example to provide better support and comfort. Any other design of bra may be adapted to aspects of the subject technology.

In preferred aspects, some or all of the bra is made of a suitably flexible supportive material. Examples include but are not limited to elastane (e.g., Spandex or Lycra) and the like.

The invention is in no way limited to the specifics of any particular embodiments and examples disclosed herein. For example, the terms "aspect," "example," "preferably," "and the like denote features that may be preferable but not essential to include in some embodiments of the invention. In addition, details illustrated or disclosed with respect to any one aspect of the invention may be used with other aspects of the invention. Additional elements may be added to various aspects of the invention and/or some disclosed elements may be subtracted from various aspects of the invention without departing from the scope of the invention. Singular elements imply plural elements and vice versa. Many other variations are possible which remain within the content, scope and spirit of the invention, and these variations would become clear to those skilled in the art after perusal of this application.

What is claimed is:

1. A bra, comprising:

a first cup configured to cover at least a portion of a first breast of a wearer;

a second cup configured to cover at least a portion of a second breast of the wearer, wherein the second cup is detachably securable to the first cup; and a retaining band disposed under and concealed by the second cup when the second cup is attached to the first cup, and wherein the retaining band covers at least a portion of the second breast when the second cup is detached from the first cup, the retaining band having a first end that is secured to the first cup to maintain the first cup in position when the second cup is detached from the first cup, and a second end attached to an outer portion of the second cup.

2. A bra as in claim 1, further comprising at least one window in at least one of the first and second cups, the at least one window configured to allow passage therethrough at least one electrocardiogram test lead.

3. A bra as in claim 1, wherein the retaining band also is detachably secured to the first cup.

4. A bra as in claim 1, further comprising a back structure coupled to the first and second cups and the retaining band, wherein the back structure is configured to wrap around a back of the wearer to hold the bra in place.

5. A bra as in claim 4, further comprising:

a first shoulder strap attached to the first cup and the back structure; and a second shoulder strap attached to the second cup and the back structure.

6. A bra as in claim 1, wherein the bra comprises a flexible supportive material.

7. A bra as in claim 5, further comprising:

a first strap adjuster coupled to the first shoulder strap; and a second strap adjuster coupled to the second shoulder strap.

8. A bra as in claim 1, further comprising at least one window in at least one of the first and second cups, and disposed closer to a center portion of the wearer's chest between the first and second breasts, the at least one window configured to allow passage therethrough a sonogram or other sensor or imaging device.

9. A bra as in claim 1, further comprising one or more clasps for test leads.

* * * * *